US007859459B2

(12) United States Patent
McCune, Jr.

(10) Patent No.: US 7,859,459 B2
(45) Date of Patent: Dec. 28, 2010

(54) PHASED ARRAY RECEIVERS AND METHODS EMPLOYING PHASE SHIFTING DOWNCONVERTERS

(75) Inventor: Earl W. McCune, Jr., Santa Clara, CA (US)

(73) Assignee: Panasonic Corporation, Osaka (JP)

( * ) Notice: Subject to any disclaimer, the term of this patent is extended or adjusted under 35 U.S.C. 154(b) by 294 days.

(21) Appl. No.: 12/098,065

(22) Filed: Apr. 4, 2008

(65) Prior Publication Data

US 2009/0251368 A1 Oct. 8, 2009

(51) Int. Cl.
*H01Q 3/00* (2006.01)

(52) U.S. Cl. ..... 342/372

(58) Field of Classification Search ..... 342/372, 342/368, 371

See application file for complete search history.

(56) References Cited

U.S. PATENT DOCUMENTS

| | | | | |
|---|---|---|---|---|
| 5,180,998 | A | 1/1993 | Willems | |
| 6,255,990 | B1 * | 7/2001 | King | 342/368 |
| 6,441,783 | B1 * | 8/2002 | Dean | 342/372 |
| 6,476,765 | B2 * | 11/2002 | Kawanabe | 342/372 |
| 2001/0038318 | A1 * | 11/2001 | Johnson et al. | 342/371 |
| 2006/0025096 | A1 * | 2/2006 | Jaffe et al. | 455/260 |
| 2006/0152416 | A1 * | 7/2006 | Mohamadi | 342/372 |
| 2006/0244656 | A1 * | 11/2006 | Lawrence et al. | 342/375 |
| 2008/0074311 | A1 * | 3/2008 | Atherton | 342/202 |
| 2009/0072921 | A1 * | 3/2009 | Schmid | 332/145 |
| 2010/0013527 | A1 * | 1/2010 | Warnick | 327/129 |

FOREIGN PATENT DOCUMENTS

JP 3212789 B * 7/2001

OTHER PUBLICATIONS

English translation of JP 3212789 B.*
Federal Standard 1037C, Telecommunications: Glossary of Telecommunications Terms, p. M-19, Aug. 1996.*
C Kykkotis et al., Performance of active antenna oscillator arrays under modulation for communication systems, IEE Proceedings Microwaves, Antennas and Propagation, vol. 145(4), p. 313-320, Aug. 1998.*
LG Castaneda et al., Phase Shifter System Using Vector Modulation for Phased Array Radar Applications, IEEE International Midwest Symposium on Circuits and Systems, vol. 2, p. 688-692, Aug. 2006.*

* cited by examiner

*Primary Examiner*—Thomas H Tarcza
*Assistant Examiner*—Fred H Mull

(57) ABSTRACT

A phased array receiver includes a plurality of receive paths having a plurality of downconverters, a plurality of digitally controlled local oscillators associated with the plurality of receive paths, and a combiner. In response to a plurality of digital phase control signals, the plurality of digitally controlled local oscillators controls phases of a plurality of local oscillator signals generated by the plurality of digitally controlled local oscillators. The phases of the plurality of local oscillator signals are introduced as phase shifts in a plurality of intermediate frequency signals produced by the plurality of downconverters. The plurality of digitally controlled local oscillators is configured to respond to changes in digital values of the plurality of digital phase control signals to achieve a desired phase relationship among the phases of the intermediate frequency signals.

21 Claims, 7 Drawing Sheets

PHASED ARRAY RECEIVERS AND METHODS EMPLOYING PHASE SHIFTING DOWNCONVERTERS

FIELD OF THE INVENTION

The present invention relates generally to phased array receivers. More specifically, the present invention relates to phased array receivers and methods that use digitally controlled phase shifting downconverters.

BACKGROUND OF THE INVENTION

Phased array receivers are used in various wireless communications systems to improve the reception of radio frequency (RF) signals. FIG. 1 is a drawing illustrating the principal components of a typical phased array receiver 100. The phased array receiver 100 includes a plurality of receive paths 102-1, 102-2, . . . , **102-*n* (where n is an integer greater than or equal to two), an RF combiner 104, and a downconverter 106. The plurality of receive paths 102-1, 102-2, . . . , 102-*n* includes antennas 108-1, 108-2, . . . , 108-*n*, low noise amplifiers (LNAs) 110-1, 110-2, . . . , 110-*n*, variable gain elements 112-1, 112-2, . . . , 112-*n*, and phase shifters 114-1, 114-2, . . . , 114-*n***.

The amplitudes and phases of RF signals received by the antennas 108-1, 108-2, . . . , **108-*n* and amplified by the LNAs 110-1, 110-2, . . . , 110-*n* are controlled by the variable gain elements 112-1, 112-2, . . . , 112-*n* and phase shifters 114-1, 114-2, . . . , 114-*n*, respectively. Typically the amplitudes and phases are controlled in such a way that reception is reinforced in a desired direction and suppressed in undesired directions. Amplitude and phase adjusted RF signals in the plurality of receive paths 102-1, 102-2, . . . , 102-*n* are combined by the RF combiner 104, and then downconverted to intermediate frequency signals by the downconverter 106**.

Successful operation of the phased array receiver 100 requires that the receive paths 102-1, 102-2, . . . , **102-*n* be precisely calibrated. When operating at RF, this requires that the physical characteristics of the transmission lines or cables used to connect the various RF elements in the plurality of receive paths 102-1, 102-2, . . . , 102-*n*** be controlled with a high degree of mechanical precision. Unfortunately, this high degree of mechanical precision is both time consuming and very expensive.

Acceptable calibration and operational control of the phases of the received RF signals in and among the plurality of receive paths 102-1, 102-2, . . . , **102-*n* of the phased array receiver 100 also calls for phase shifters 114-1, 114-2, . . . , 114-*n* that are capable of controlling signal phases both accurately and with high resolution. Together, accuracy and high resolution afford the ability to maximize the phase alignment of the RF signals at the input of the RF combiner 104, thereby optimizing the reception capabilities of the receiver 100**. Unfortunately, phase shifters that offer both accuracy and high resolution at RF frequencies, and which are also inexpensive to manufacture, are not readily available.

Generally, prior art phased array receivers employ one of two types of phase shifters. The first type of phase shifter 200, shown in FIG. 2A, includes a plurality of selectable transmission line sections 202-1, 202-2, 202-3, . . . , **202-*n* configured as delay elements. Typically, the selectable transmission line sections 202-1, 202-2, 202-3, . . . , 202-*n* are strip lines or microstrip lines formed in a monolithic microwave integrated circuit (MMIC). Junctions formed between adjacent transmission line sections 202-1, 202-2, 202-3, . . . , 202-*n* are selectably shunted to ground by selected operation of transistors 206-1, 206-2, . . . , 206*n*−1. Which of the transistors 206-1, 206-2, . . . , 206*n*−1 is ON and which is OFF is determined by a controller 208. An RF input signal that is launched from a circulator 204 and which encounters the first short circuit signal in its path (determined by which of the transistors 206-1, 206-2, . . . , 206*n*−1 is ON) is reflected back to the circulator 204**, appearing as an RF output signal RFOUT. The phase difference between the phase of RFOUT and the phase of RFIN is, therefore, proportional to twice the sum of the lengths of the transmission line sections over which the RF signal traveled.

The phase shifter 200 in FIG. 2A can be made so that it is quite accurate. However, because there only a few discrete phase shift values available, the resolution to which the phase shifts can be controlled is quite low, particularly when the RF signals being shifted have very high frequencies. FIG. 2B is a drawing of a second type of phase shifter 200' commonly used in phased array receivers, and which offers a higher resolution than the phase shifter 200 in FIG. 2A. The phase shifter 200' comprises an in-phase mixer 220, a quadrature mixer 222, and a summer 224. The in-phase and quadrature mixers 220 and 222 are configured to mix an RF input signal RFIN with in-phase (I) and quadrature (Q) signals. Phase shifts to RFIN are introduced by varying the amplitudes of the I and Q signals. The resulting phase shifted signal RFOUT appears at the output of the summer 224.

Although the phase shifter 200' in FIG. 2B can be controlled with greater resolution than the phase shifter 200 in FIG. 2A, it is not very accurate. In particular, when configured in multiple receive paths of a phased array receiver, gain variations among the phase shifters 200' in the different paths, along with even small misalignments of the I and Q signals applied to the multiple phase shifters 200', result in inaccuracies among the phases of the RF signals in the multiple receive paths 102-1, 102-2, . . . , **102-*n***.

Considering the foregoing drawbacks and limitations of prior art phased array receiver approaches, it would be desirable to have phased array receivers and methods that provide the ability to control the phases of signals both accurately and with high resolution, and which also are not burdened by expensive and difficult calibration techniques requiring a high level of mechanical precision.

BRIEF SUMMARY OF THE INVENTION

Phased array receivers and methods employing digitally controlled phase shifting downconverters are disclosed. An exemplary phased array receiver includes a plurality of receive paths having a plurality of downconverters, a plurality of digitally controlled local oscillators associated with the plurality of receive paths, and a combiner. In response to a plurality of digital phase control signals, the plurality of digitally controlled local oscillators controls the phases of a plurality of local oscillator signals generated by the plurality of digitally controlled local oscillators. The phases of the plurality of local oscillator signals are introduced as phase shifts in a plurality of intermediate frequency signals produced by the plurality of downconverters in the plurality of receive paths. The plurality of digitally controlled local oscillators is configured to respond to changes in digital values of the plurality of digital phase control signals to achieve a desired phase relationship among the phases of the intermediate frequency signals. The plurality of receive paths may further include a plurality of digitally controlled variable gain elements configured to respond to changes in digital values of a plurality of digital gain control signals, to achieve a desired amplitude relationship among the intermediate frequency signals.

According to another aspect of the invention, a phased array receiver, similar to the phased array receiver summarized above, is combined with one or more polar modulation transmitters to form a phased array transceiver. The digital phase and gain control signals for the plurality of receive paths of the phased array receiver are provided by one or more polar signal generators of the one or more polar modulation transmitters. The ability to exploit the polar signal generator(s) of the one or more polar modulation transmitters, which would otherwise be operable for the sole purpose of generating the polar modulation signals for the polar modulation transmitter(s), significantly reduces the cost and complexity of the phased array transceiver.

Further features and advantages of the present invention, as well as the structure and operation of the above-summarized and other exemplary embodiments of the invention, are described in detail below with respect to accompanying drawings, in which like reference numbers are used to indicate identical or functionally similar elements.

DETAILED DESCRIPTION

Figure 1:
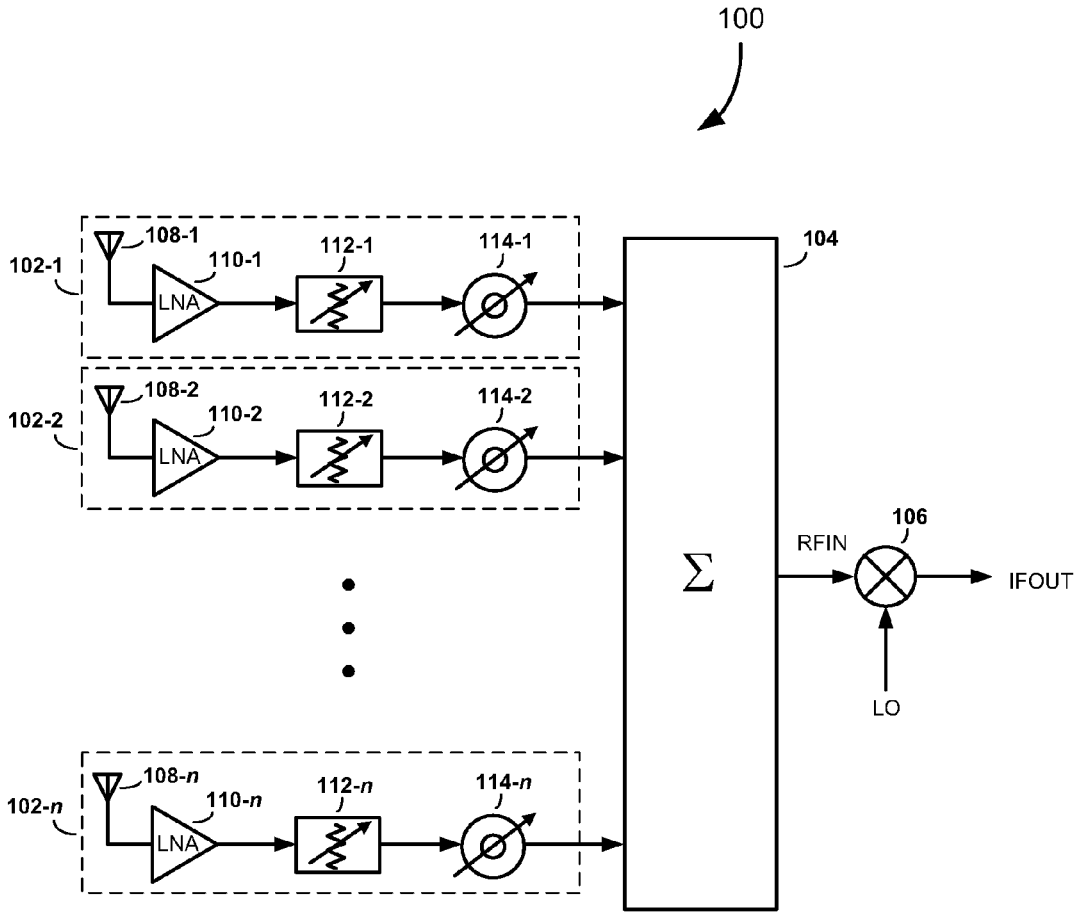
FIGURE 1 (Prior Art)
FIG. 1 is a drawing illustrating the principal components of a conventional phased array receiver.
Figure 2A:
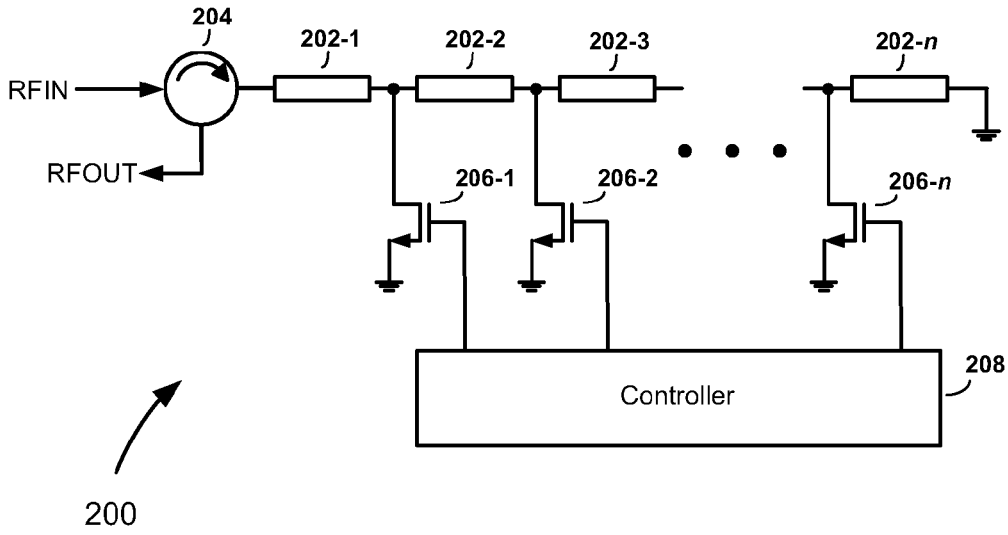
FIGURE 2A (Prior Art)
FIG. 2A is a drawing of a prior art phase shifter that employs a plurality of selectable transmission line sections as delay elements.
Figure 2B:
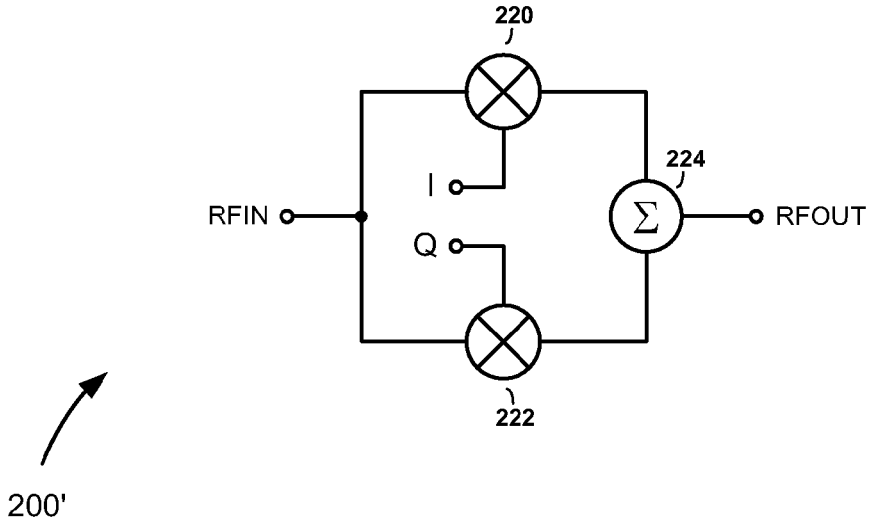
FIGURE 2B (Prior Art)
FIG. 2B is a drawing of a prior art phase shifter that employs a quadrature mixer.
Figure 3:
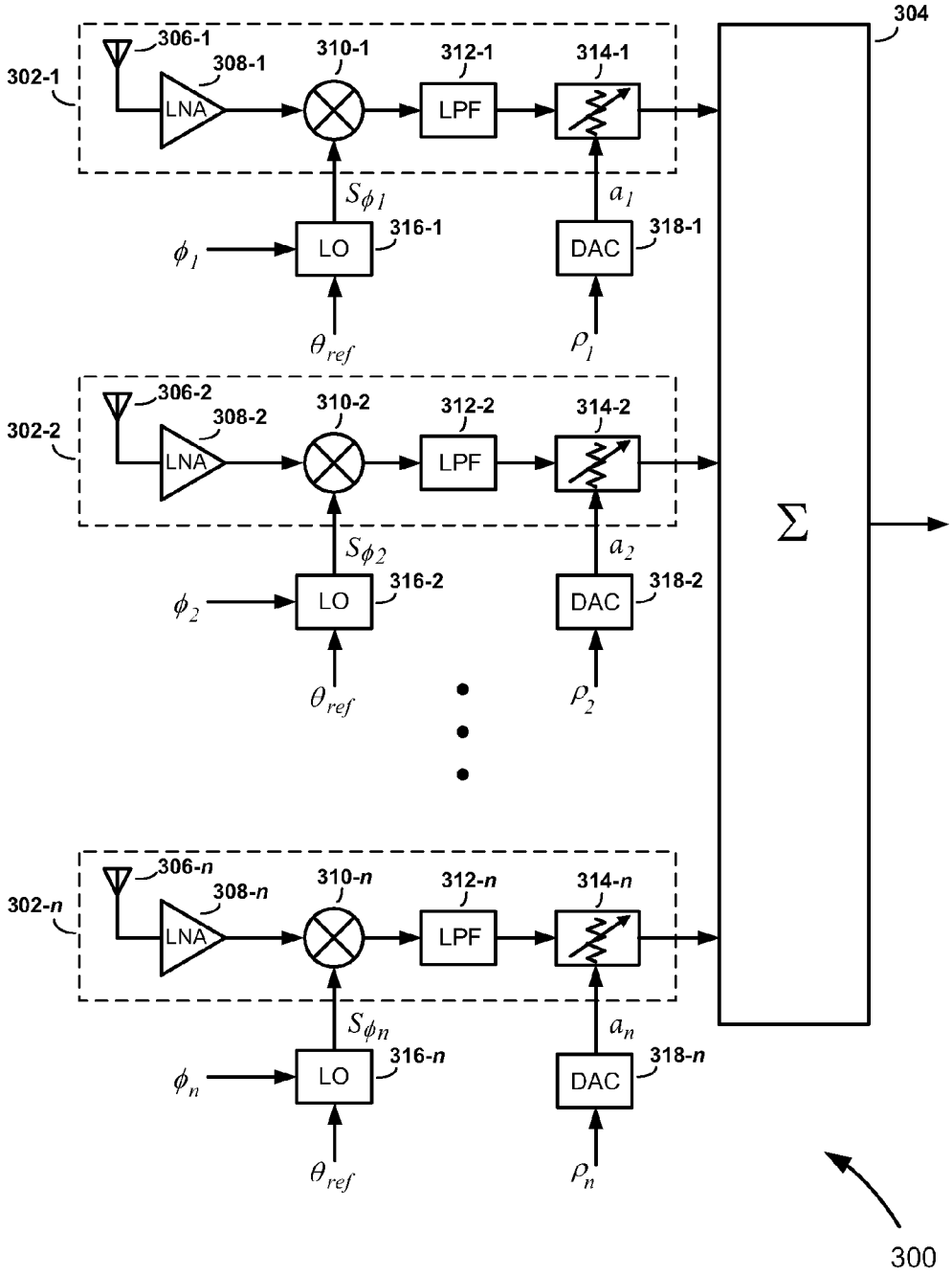
FIG. 3 is a drawing of a phased array receiver 300, according to an embodiment of the present invention.

Referring to FIG. 3, there is shown a phased array receiver 300, according to an embodiment of the present invention. The phased array receiver 300 comprises a plurality of receive paths 302-1, 302-2, . . . , **302-*n*, where n is an integer that is greater than or equal to two, and a combiner 304. The plurality of receive paths 302-1, 302-2, . . . , 302-*n* includes antenna elements 306-1, 306-2, . . . , 306-*n*, low-noise amplifiers (LNAs) 308-1, 308-2, . . . , 308-*n*, downconverters 310-1, 310-2, . . . , 310-*n*, low-pass filters (LPFs) 312-1, 312-2, . . . , 312-*n*, and variable gain elements 314-1, 314-2, . . . , 314-*n***.

RF signals captured by the antenna elements 306-1, 306-2, . . . , **306-*n* in the plurality of receive paths 302-1, 302-2, . . . , 302-*n* are amplified by the LNAs 308-1, 308-2, . . . , 308-*n* and then coupled to first inputs of the downconverters 310-1, 310-2, . . . , 310-*n*. As the amplified RF signals are applied to the first inputs of the downconverters 310-1, 310-2, . . . , 310-*n*, local oscillator signals $S_{\phi 1}$, $S_{\phi 2}$, . . . , $S_{\phi n}$ from a plurality of associated local oscillators (LOs) 316-1, 316-2, . . . , 316-*n* are coupled to second inputs of the downconverters 310-1, 310-2, . . . , 310-*n*. The local oscillator signals $S_{\phi 1}$, $S_{\phi 2}$, . . . , $S_{\phi n}$ all have the same intermediate frequency (IF), but have different phases determined by a plurality of digital phase control signals $\phi_1$, $\phi_2$, . . . , $\phi_n$ applied to phase control inputs of the plurality of LOs 316-1, 316-2, . . . , 316-*n*. The digital phase control signals $\phi_1$, $\phi_2$, . . . , $\phi_n$ comprise fixed or variable digital numbers representing phase shifts to be introduced into respective receive paths 302-1, 302-2, . . . , 302-*n*. (Note that the digital phase control signals $\phi_1$, $\phi_2$, . . . , $\phi_n$ are named according to the phases they represent. This same naming approach is used to refer to other digital signals in the various embodiments of the invention described herein.) The downconverters 310-1, 310-2, . . . , 310-*n* downconvert the received RF signals in the plurality of receive paths 302-1, 302-2, . . . , 302-*n* to IF, and at the same time introduce phase shifts into the downconverted signals according to the phases of the local oscillator signals $S_{\phi 1}$, $S_{\phi 2}$, . . . , $S_{\phi n}$. The downconversion process also yields high frequency signals having a frequency equal to the sum of the frequencies of the IF and RF signals. These high frequency byproducts are unwanted and are, therefore, filtered out by the low-pass filters (LPFs) 312-1, 312-2, . . . , 312-*n***.

Following filtering, the variable gain elements 314-1, 314-2, . . . , **314-*n* modify the amplitudes of the downconverted IF signals according to analog gain control signals $a_1$, $a_2$, . . . , $a_n$ and the signals are combined by the combiner 304. The analog gain control signals $a_1$, $a_2$, . . . , $a_n$ are provided from a plurality of associated digital-to-analog converters (DACs) 318-1, 318-2, . . . , 318-*n***, and have amplitudes determined and controlled by digital gain control signals $\rho_1$, $\rho_2$, . . . , $\rho_n$. Accordingly, similar to the digital phase control signals $\phi_1$, $\phi_2$, . . . , $\phi_n$ determining and controlling the phases of the local oscillator signals $S_{\phi 1}$, $S_{\phi 2}$, . . . , $S_{\phi n}$, the digital gain control signals $\rho_1$, $\rho_2$, . . . , $\rho_n$ determine and control the amplitudes of the analog gain control signals $a_1$, $a_2$, . . . , $a_n$.

The digital phase and gain control aspect of the present invention offers a number of advantages over conventional phased array approaches. First, the amplitudes and phases of the signals in the plurality of receive paths 302-1, 302-2, . . . , **302-*n* are set and controlled using digital signals. Digital control provides both accuracy and high resolution and is significantly less susceptible to drift compared to prior art analog control approaches. The accuracy and resolution are limited only by the number of bits used in the digital gain and phase control signals $\rho_1$, $\rho_2$, . . . , $\rho_n$ and $\phi_1$, $\phi_2$, . . . , $\phi_n$. Second, the phases and amplitudes of signals in the plurality of receiver paths 302-1, 302-2, . . . , 302-*n* are set and controlled at IF, not at RF as in prior art approaches. This greatly simplifies setting and controlling the amplitudes and phases of the signals in each of the receive path 302-1, 302-2, . . . , 302-*n*, as well as setting and controlling the relative amplitudes and phase differences among the signals in the plurality of receive paths 302-1, 302-2, . . . , 302-*n*. Third, phase shifts are introduced into the receive paths 302-1, 302-2, . . . , 302-*n* by inexpensive dual-purpose downconverters 310-1, 310-2, . . . , 310-*n*. The downconverters 310-1, 310-2, . . . , 310-*n* are "dual-purpose" in the sense that they operate to introduce the phase shifts in the receive paths 302-1, 302-2, . . . , 302-*n*, in addition to downconverting the receive RF signals to IF. Use of the downconverters 310-1, 310-2, . . . , 310-*n* to set and control the desired phase shifts obviates the need for separate and dedicated RF phase shifters. Finally, the combining operation of the signal combiner 304** is also performed at IF, rather than at RF. Hence, compared to prior art RF combining processes, the combining process is also greatly simplified.

Figure 4:
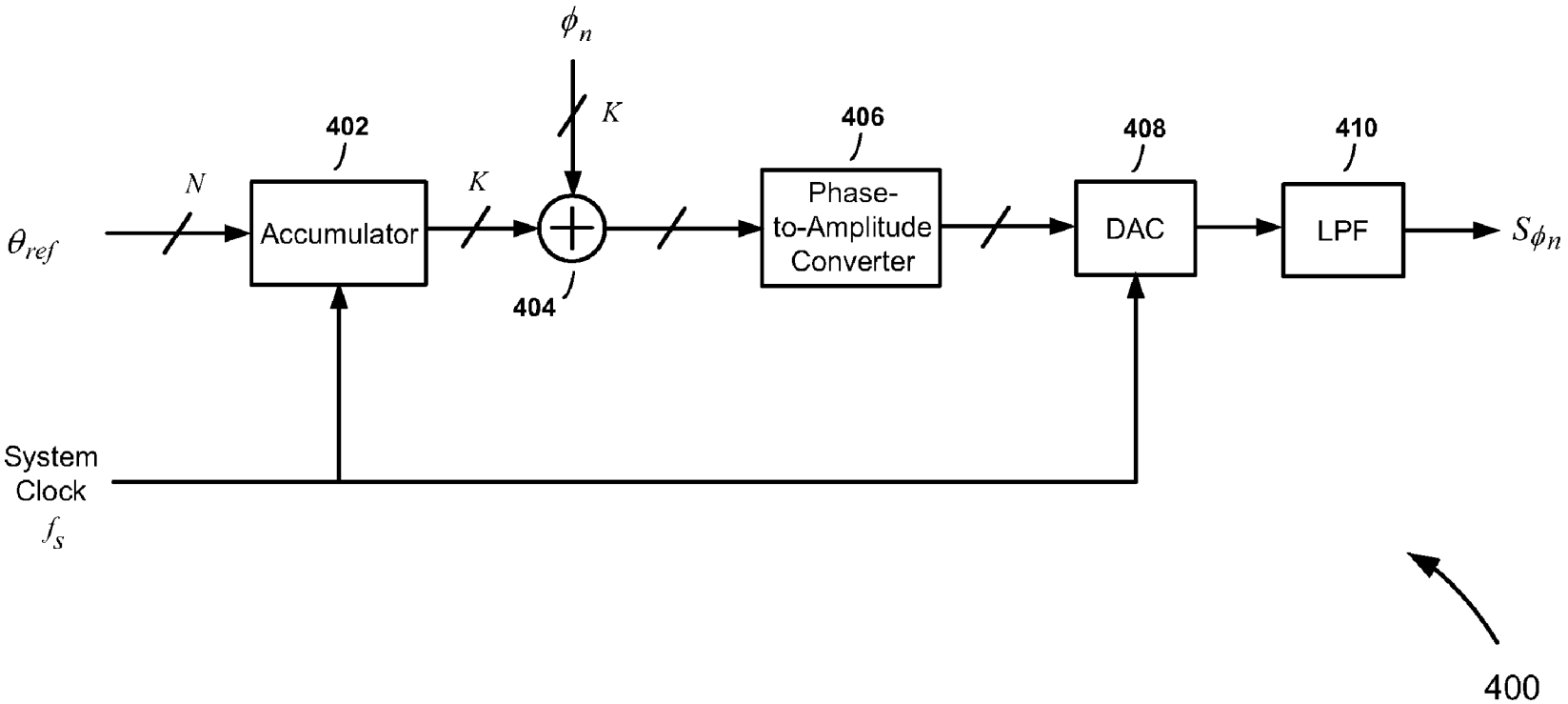
FIG. 4 is a drawing of an exemplary digitally controlled local oscillator (DCO), which may be used to implement the local oscillators (LOs) in the phased array receiver in FIG. 3.

FIG. 4 is a drawing of an exemplary digitally controlled oscillator (DCO) 400 that may be used to implement the LOs 316-1, 316-2, . . . , **316-*n* of the phased array receiver 300 in FIG. 3. The drawing illustrates, in particular, how the digitally controlled DCO 400 can be configured to generate the nth local oscillator signal $S_{\phi n}$ for the nth receive path 302-*n* of the phased array receiver 300. (The LOs 316-1, 316-2, . . . , 316-*n*−1 for the other receive paths 302-1, 302-2, . . . , 302-*n*−1 would be similarly configured, as will be readily appreciated by those of ordinary skill in the art.) The DCO 400 is implemented in the form of a direct digital synthesizer (DDS) comprising an accumulator 402, an adder 404, a phase-to-amplitude converter 406, a DAC 408, and an LPF 410. The accumulator 402 is driven by a system clock having a frequency $f_s$, and accumulates successive phase samples of an N-bit digital reference phase signal $\theta_{ref}$ (N is an integer greater than or equal to two) until it reaches capacity and overflows. The accumulation and overflow processes are repeated, and the rate at which the accumulator 402 overflows, together with the value of the N-bit digital reference phase signal $\theta_{ref}$, determine the ultimate output frequency of the DCO 400** (which in this case is the frequency of the first local oscillator signal $S_{\phi n}$).

The K most significant bits (where $K \leqq N$) of the accumulator output, which carry a digital reference phase number, are coupled to a first input of the adder 404 while the digital phase control signal $\phi_n$ (also K bits in length) is applied to a second input of the adder 404. As explained above, the digital phase control signal $\phi_n$ comprises a fixed or variable digital phase control number representing the phase shift to be introduced to signals received in the nth receive path **302-*n*. (Note that the phase shift resolution provided by the digitally controlled DCO 400 is equal to $360°/2^K$. So, for maximum resolution K=N. Lower resolutions (K<N) may be used to simplify circuit complexity and save power.) The adder 404 produces a digital sum representing the sum of phases represented by the accumulator digital output and the digital phase control signal $\phi_n$. The phase-to-amplitude converter 406 generates a digital sine wave from the digital sum. The digital sine wave is converted to an analog sine wave by the DAC 408 and, finally, low-pass filtered by the LPF 410 to reconstruct the desired sinusoidal waveform and remove unwanted high-frequency components. The final filtered sinusoidal waveform is the desired first local oscillator signal $S_{\phi n}$. As previously mentioned, the other local oscillator signals $S_{\phi 1}$, $S_{\phi 2}$, . . . , $S_{\phi n-1}$, for the other receive paths 302-1, 302-2, . . . , 302-*n*−1** can be generated by other similarly configured digitally controlled LOs.

According to an embodiment of the invention, the digital gain control signals $\rho_1, \rho_2, \ldots, \rho_n$ used to generate the analog gain control signals $a_1, a_2, \ldots, a_n$ for the variable gain elements 314-1, 314-2, . . . , **314-*n* and the digital phase control signals $\phi_1, \phi_2, \ldots, \phi_n$ used by the plurality of LOs 316-1, 316-2, . . . , 316-*n* to generate the local oscillator signals $S_{\phi 1}, S_{\phi 2}, \ldots, S_{\phi n}$ in the phased array receiver 300 in FIG. 3 comprise digital beamforming vectors $(\rho_{beam_1}, \theta_{beam_1}), (\rho_{beam_2}, \theta_{beam_2}), \ldots, (\rho_{beam_n}, \theta_{beam_n})$. The digital beamforming vectors $\rho_{beam_1}, \theta_{beam_1}), (\rho_{beam_2}, \theta_{beam_2}), \ldots, (\rho_{beam_n}, \theta_{beam_n})$ have digital values based either on empirical data or values computed on-the-fly from an adaptive feedback process. In the latter circumstance, the digital values of the digital beamforming vectors $(\rho_{beam_1}, \theta_{beam_1}), (\rho_{beam_2}, \theta_{beam_2}), \ldots, (\rho_{beam_n}, \theta_{beam_n})$ are dynamically adjusted during operation so that signals received in the plurality of receive paths 302-1, 302-2, . . . , 302-*n* combine constructively in the direction of a target that is moving with respect to the receiver 300** and combine destructively (i.e., are "nulled") in directions of undesired objects.

It should be understood that the phased array receiver 300 in FIG. 3 may be adapted to receive digital beamforming vectors $(\rho_{beam_1}, \theta_{beam_1}), (\rho_{beam_2}, \theta_{beam_2}), \ldots, (\rho_{beam_n}, \theta_{beam_n})$ generated according to any one of a number of beamforming algorithms, and should not be viewed as being restricted to any particular algorithm. Some exemplary beamforming algorithms and other smart antenna digital processing algorithms that may be used, are described in "Smart Antennas for Wireless Communications," Frank Gross, McGraw-Hill, 2005, "MIMO Wireless Communications: From Real-World Propagation to Space-Time Code Design," Claude Oestges, Bruno Clerckx, Elsevier Ltd., 2007, and "Smart Antenna Engineering," Ahmed El-Zooghby, Artech House, Inc., 2005, all of which are hereby incorporated by reference.

According to another embodiment of the invention, the plurality of receive paths 302-1, 302-2, . . . , **302-*n* of the phased array receiver 300 in FIG. 3 is configured to receive digital calibration vectors $(\rho_{cal_1}, \theta_{cal_1}), (\rho_{cal_2}, \theta_{cal_2}), \ldots, (\rho_{cal_n}, \theta_{cal_n})$. The digital calibration vectors $(\rho_{cal_1}, \theta_{cal_1}), (\rho_{cal_2}, \theta_{cal_2}), \ldots, (\rho_{cal_n}, \theta_{cal_n})$ have digital values that account for physical and/or electrical variances among the plurality of receive paths 302-1, 302-2 . . . , 302-*n*. The physical and/or electrical variances are determined during manufacturing testing or by application of a post-manufacturing characterization process. Digital values of the digital calibration vectors $(\rho_{cal_1}, \theta_{cal_1}), (\rho_{cal_2}, \theta_{cal_2}), \ldots, (\rho_{cal_n}, \theta_{cal_n})$ are then assigned based on the testing or characterization results. Similar to the digital beamforming vectors $(\rho_{beam_1}, \theta_{beam_1}), (\rho_{beam_2}, \theta_{beam_2}), \ldots, (\rho_{beam_n}, \theta_{beam_n})$, the digital calibration vectors $(\rho_{cal_1}, \theta_{cal_1}), (\rho_{cal_2}, \theta_{cal_2}), \ldots, (\rho_{cal_n}, \theta_{cal_n})$ are converted to local oscillator and gain calibration signals and introduced to the downconverters 310-1, 310-2, . . . , 310-*n* and variable gain elements 314-1, 314-2, . . . , 314-*n***.

The digital calibration aspect of the present invention is superior to prior art calibration approaches that require mechanical adjustments to achieve calibration. Mechanical variances in the construction of the phased array receiver 300 can be accounted for simply by changing the digital values of the digital calibration vectors $(\rho_{cal_1}, \theta_{cal_1}), (\rho_{cal_2}, \theta_{cal_2}), \ldots, (\rho_{cal_n}, \theta_{cal_n})$, rather than by tedious mechanical adjustment. Temperature dependent variations in the operation of the plurality of receive paths 302-1, 302-2, . . . , **302-*n*** can also be easily calibrated out, again simply by changing the digital values of the digital calibration vectors $(\rho_{cal_1}, \theta_{cal_1}), (\rho_{cal_2}, \theta_{cal_2}), \ldots, (\rho_{cal_n}, \theta_{cal_n})$.

Figure 5:
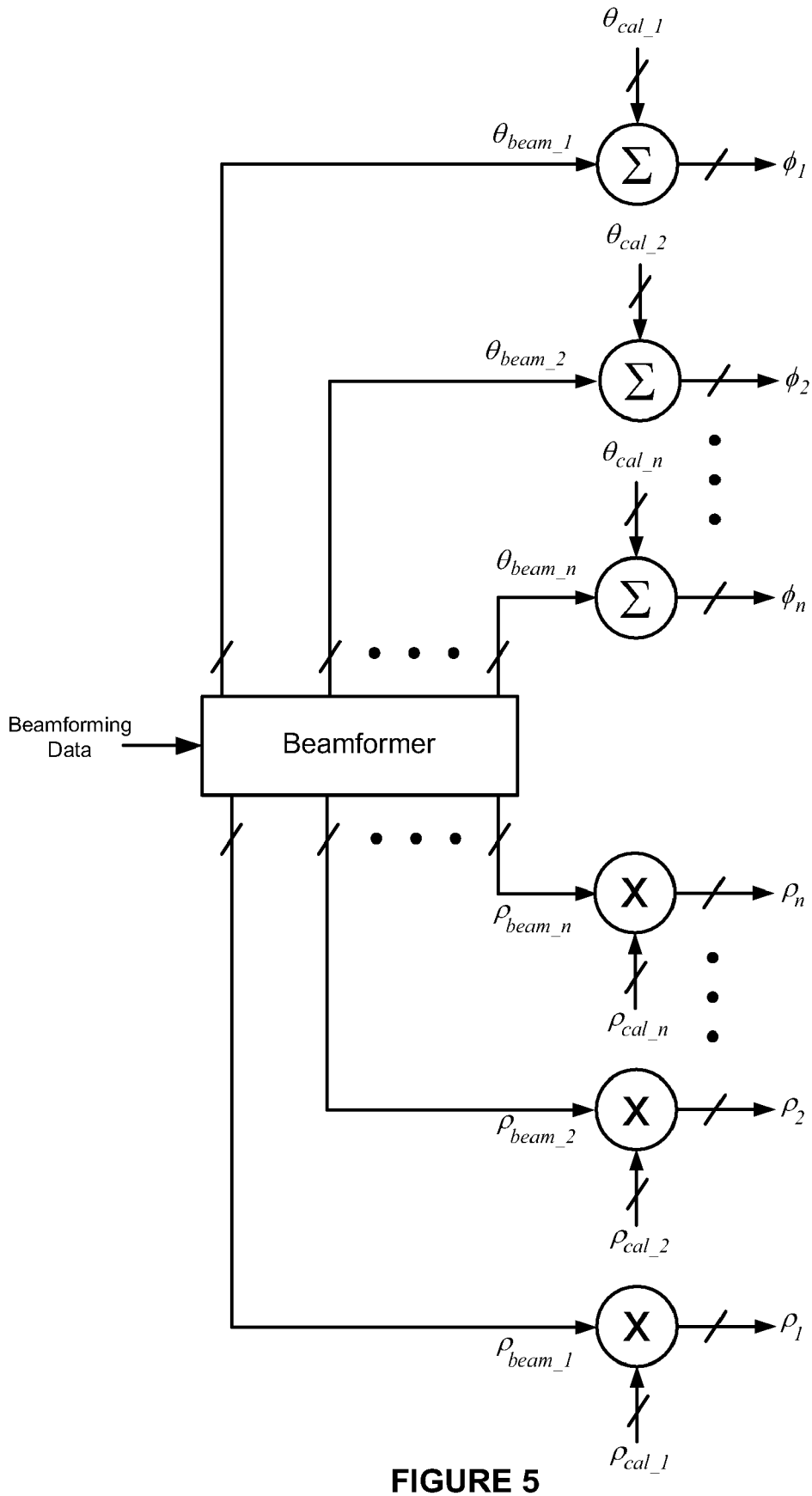
FIG. 5 is a drawing illustrating how digital calibration vectors can be summed with digital beamforming to generate resultant digital calibration and beamforming vectors.

The digital calibration vectors $(\rho_{cal_1}, \theta_{cal_1}), (\rho_{cal_2}, \theta_{cal_2}), \ldots, (\rho_{cal_n}, \theta_{cal_n})$ may be used to calibrate the phased array receiver 300 independent of any beamforming function. Alternatively, they may be combined with the digital beamforming vectors $(\rho_{beam_1}, \theta_{beam_1}), (\rho_{beam_2}, \theta_{beam_2}), \ldots, (\rho_{beam_n}, \theta_{beam_n})$, as illustrated in FIG. 5. The phase components $\phi_1=(\theta_{cal_1}+\theta_{beam_1}), \phi_2=(\theta_{cal_2}+\theta_{beam_2}), \ldots, \phi_n=(\theta_{cal_n}+\theta_{beam_n})$ of the resultant calibration and beamforming vectors are then applied to digitally controlled LOs (similar to the DCO 400 shown and described above in FIG. 4, for example), to generate the local oscillator signals $S_{\phi 1}, S_{\phi 2}, \ldots, S_{\phi n}$ for the plurality of receive paths 302-1, 302-2, . . . , **302-*n*. At the same time, the amplitude components $\rho_1=(\rho_{cal_1}\times\rho_{beam_1}), \rho_2=(\rho_{cal_2}\times\rho_{beam_2}), \ldots, \rho_n=(\rho_{cal_n}\times\rho_{beam_n})$ of the resultant digital beamforming and calibration vectors are applied to the DACs 318-1, 318-2, . . . , 318-*n*, which, in response, generate the analog gain control signals $a_1, a_2, \ldots, a_n$ for the variable gain elements 314-1, 314-2 . . . , 314-*n***.

Figure 6:
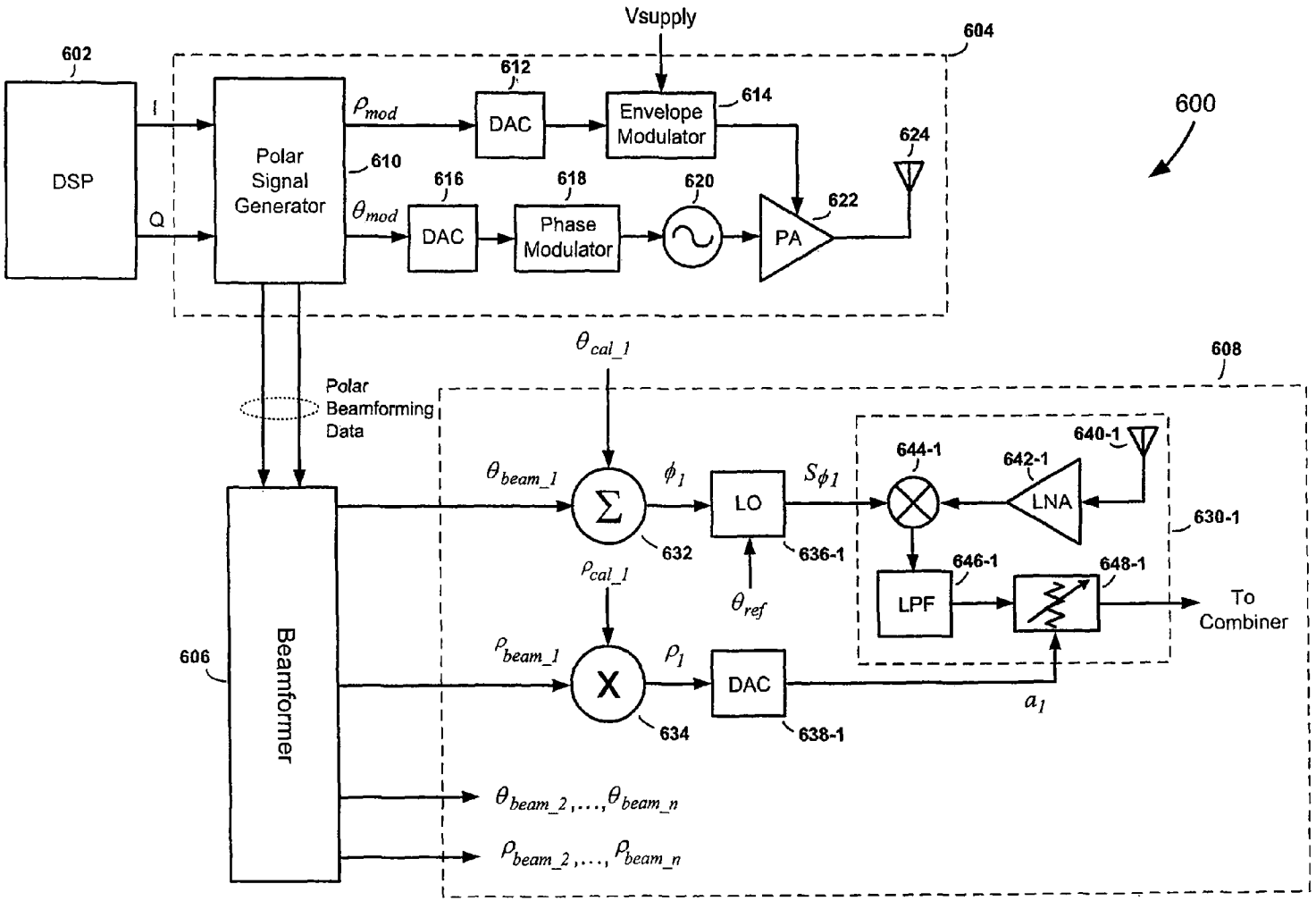
FIG. 6 is an exemplary phased array transceiver, according to an embodiment of the present invention.

Referring now to FIG. 6, there is shown an exemplary phased array transceiver 600, according to another embodiment of the present invention. The phased array transceiver 600 comprises a digital signal processor (DSP) 602, a polar modulation transmitter 604, a beamformer 606, and a phased array receiver 608 (with only one receiver path 630-1 shown to simplify illustration and the description that follows). According to this embodiment of the invention, digital gain and phase control signals are provided by the polar signal generator 610 to the beamformer 606, which uses the digital gain and phase control signals to generate digital beamforming vectors $(\rho_{beam_1}, \theta_{beam_1}), (\rho_{beam_2}, \theta_{beam_2}), \ldots, (\rho_{beam_n}, \theta_{beam_n})$, for the phased array receiver 608. The ability to exploit the already present polar signal generator 610, which would otherwise be operable for the sole purpose of generating the polar modulation signals for the polar transmitter 604, significantly reduces the cost and complexity of the phased array transceiver 600.

The polar modulation transmitter 604 of the phased array transceiver 600 comprises a polar signal generator 610; an amplitude path including an amplitude path digital-to-analog converter (DAC) 612 and an envelope modulator 614; a phase path including a phase path DAC 616, phase modulator 618 and RF oscillator 620; an RF power amplifier (PA) 622, and an antenna 624. The polar signal generator 610 converts digital in-phase (I) and quadrature phase (Q) modulation signals from the DSP 602 into digital polar modulation signals having an amplitude modulation component $\rho_{mod}$ and a phase modulation component $\theta_{mod}$. The digital amplitude and phase modulation components $\rho_{mod}$ and $\theta_{mod}$ are converted by the amplitude path DAC 612 and phase path DAC 616, respectively, to analog envelope and phase modulation signals, respectively. The envelope modulation signal is received by the envelope modulator 614, which operates to modulate a direct current (DC) power supply signal Vsupply according to amplitude variations in the envelope modulation signal, thereby providing an amplitude modulated power supply signal. Meanwhile, the phase modulator 618 and RF oscillator in the phase path respond to the phase modulation signal provided by the phase path DAC 616, by generating a constant-peak-amplitude RF signal. The constant-peak-amplitude RF signal is applied to an RF input of the RF PA 622 while the amplitude modulated power supply signal is applied to a power setting port of the RF PA 622. The RF PA 622 comprises a highly efficient nonlinear PA (e.g., a Class D, E or F switch-mode PA) configured to operate in compression. Hence, the RF signal produced at the output of the RF PA 622 is an RF signal containing both the envelope and phase modulations of the original baseband signal.

As alluded to above, in addition to generating and providing the digital polar modulation signals for the polar modulation transmitter 604, the polar signal generator 610 is configured to provide digital gain and phase control signals to the beamformer 606. Using the digital gain and phase control signals, the beamformer 606 generates the beamforming vectors $(\rho_{beam_1}, \theta_{beam_1}), (\rho_{beam_2}, \theta_{beam_2}), \ldots, (\rho_{beam_n}, \theta_{beam_n})$ for the phased array receiver 608. (Although not shown in the drawing, those of ordinary skill in the art will appreciate and understand that the polar signal generator 610 may be further configured to provide polar calibration data for the generation of the digital calibration vectors $(\rho_{cal_1}, \theta_{cal_1}), (\rho_{cal_2}, \theta_{cal_2}), \ldots, (\rho_{cal_n}, \theta_{cal_n})$.) The digital beamforming vectors $(\rho_{beam_1}, \theta_{beam_1}), (\rho_{beam_2}, \theta_{beam_2}), \ldots, (\rho_{beam_n}, \theta_{beam_n})$ generated by the beamformer 606 are combined with corresponding digital calibration vectors $(\rho_{cal_1}, \theta_{cal_1}), (\rho_{cal_2}, \theta_{cal_2}), \ldots, (\rho_{cal_n}, \theta_{cal_n})$ (similar to described above in connection with FIG. 5), thereby generating digital phase control signals $\Phi_1=(\theta_{cal_1}+\theta_{beam_1}), \Phi_2=(\theta_{cal_2}+\theta_{beam_2}), \ldots, \Phi_n=(\theta_{cal_n}+\theta_{beam_n})$ and digital gain control signals $\rho_1=(\rho_{cal_1}+\rho_{beam_1}), \rho_2=(\rho_{cal_2}+\rho_{beam_2}), \ldots, \rho_n=(\rho_{cal_n}+\rho_{beam_n})$. FIG. 6 illustrates, for example, how first and second summers 632 and 634 are employed to generate the digital phase and gain control signals $\Phi_1$ and $\rho_1$ for the first receiver path 630-1 of the phased array receiver 608.

The digital phase control signals $\phi_1=(\theta_{cal_1}+\theta_{beam_1}), \phi_2=(\theta_{cal_2}+\theta_{beam_2}), \ldots, \phi_n=(\theta_{cal_n}+\theta_{beam_n})$ are coupled to phase control inputs of a plurality of digitally controlled LOs in the plurality of receive paths of the phased array receiver 608, similar to described above in connection with FIG. 4. The plurality of digitally controlled LOs operates to generate a plurality of local oscillator signals $S_{\phi 1}, S_{\phi 2}, \ldots, S_{\phi n}$ having phases determined by the digital phase control signals $\phi_1=(\theta_{cal_1}+\theta_{beam_1}), \phi_2=(\theta_{cal_2}+\theta_{beam_2}), \ldots, \phi_n=(\theta_{cal_n}+\theta_{beam_n})$, relative to the digital reference phase signal $\phi_{ref}$. FIG. 6 illustrates, for example, how the LO 636-1 associated with the first receive path 630-1 of the phased array receiver 608 is configured to generate the first local oscillator signal $S_{\phi 1}$.

A plurality of downconverters configured within the receive paths of the phased array receiver 300 downconvert RF signals received in the plurality of receive paths of the phased array receiver 608 to IF. As the RF signals are downconverted, the downconverters introduce phase shifts into the signals, according to the phases of the local oscillator signals $S_{\phi 1}, S_{\phi 2}, \ldots, S_{\phi n}$. FIG. 6 illustrates, for example, how the downconverter 644-1 in the first receive path 630-1 of the phased array receiver 608 I configured to downconvert RF signals received and amplified by an associated antenna element 640-1 and associated LNA 642-1, and introduce a phase shift into the downconverted signals according to the phase of the first local oscillator signal $S_{\phi 1}$.

As the local oscillator signals $S_{\phi 1}, S_{\phi 2}, \ldots, S_{\phi n}$ are being generated by the digitally controlled LOs, the digital gain control signals $\rho_1=(\rho_{cal_1}\times\rho_{beam_1}), \rho_2=(\rho_{cal_2}\times\rho_{beam_2}), \ldots, \rho_n=(\rho_{cal_n}\times\rho_{beam_n})$ are converted to analog gain control signals $a_1, a_2, \ldots, a_n$ by a plurality of DACs. The analog gain control signals $a_1, a_2, \ldots, a_n$ are coupled to the variable gain elements of their respective paths. FIG. 6 shows, for example, how a DAC 638-1 associated with the first receive path 630-1 of the phased array receiver 608 is configured to convert the first digital gain control signal $\rho_1$ to the first analog gain control signal $a_1$, and how the first analog gain control signal $a_1$ is coupled to a variable gain element 648-1 configured within the first receive path 630-1.

Figure 7:
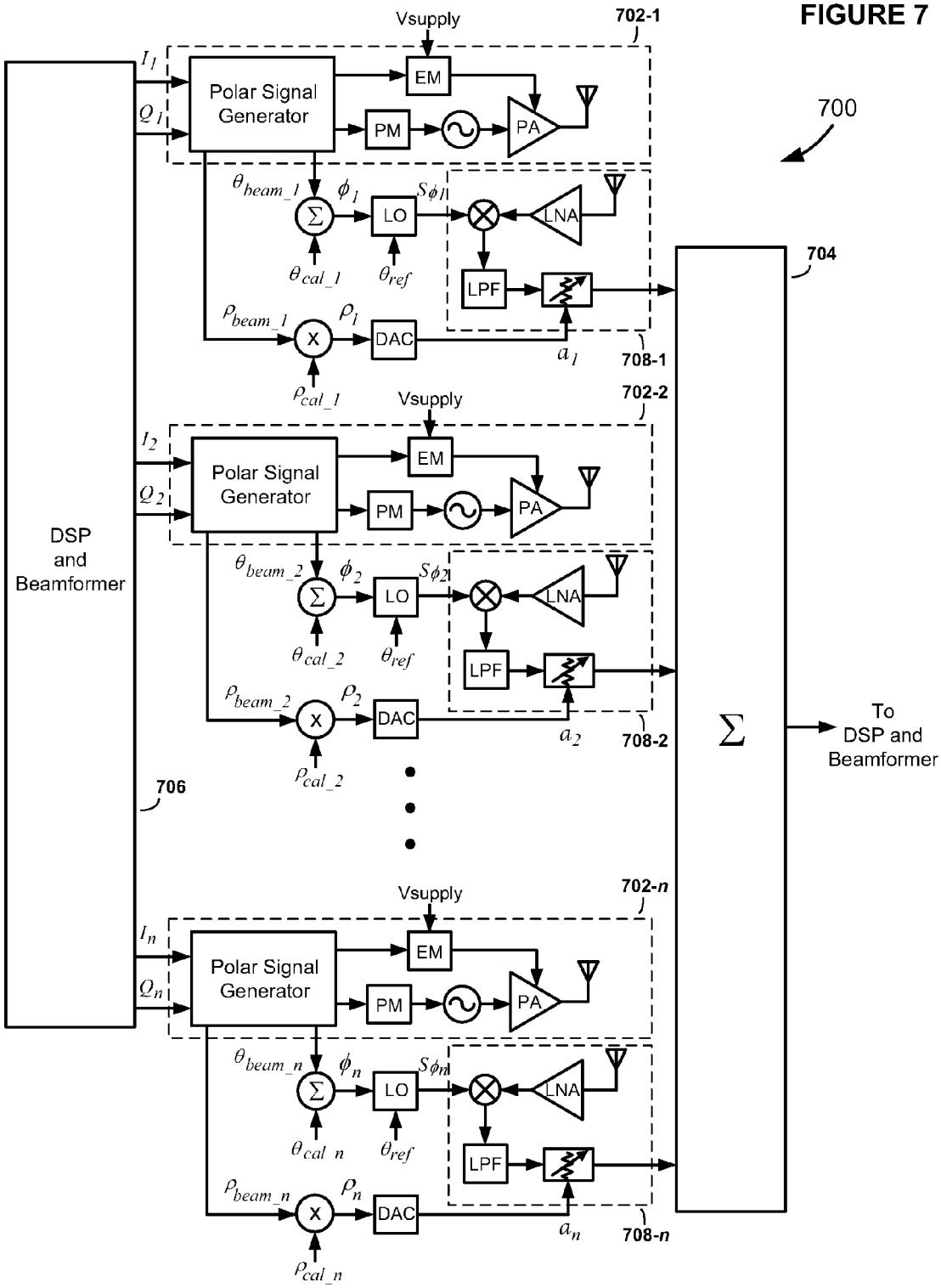
FIG. 7 is an exemplary phased array transceiver, according to another embodiment of the present invention.

The phased array transceiver 600 in FIG. 6 includes a single polar modulation transmitter 604 with a dedicated antenna element 624 and a phased array receiver 608 having a plurality of receive paths with a corresponding plurality of antenna elements. It is, therefore, well suited for use in single input multiple output (SIMO) communications applications. FIG. 7 is a drawing of an alternative phased array transceiver 700 in which a plurality of polar modulation transmitters 702-1, 702-2, . . . , **702-*n* is employed. The plurality of polar modulation transmitters 702-1, 702-2, . . . , 702-*n*, together with associated receive paths 708-1, 708-2, . . . , 708-*n* of a phased array receiver, afford the ability to operate the phased array transceiver 700** in multiple input multiple output (MIMO) communications applications.

The structure and functions performed by the phased array transceiver 700 are similar to the structure and functions of the phased array transceiver 600 in FIG. 6, with a few differences. First, instead of employing just a single polar modulation transmitter 604 as in the phased array transceiver 600 shown and described in FIG. 6, the phased array transceiver 700 in FIG. 7 employs a plurality of polar modulation transmitters 702-1, 702-2, . . . , **702-*n*, each one corresponding to an associated receive path of the plurality of receive paths 708-1, 708-2, . . . , 708-*n*. Note, however, that while a plurality of associated polar signal generators is shown as being employed, a single polar signal generator configured to generate and provide the digital beamforming vectors ($\rho_{beam_1}$, $\theta_{beam_1}$), ($\rho_{beam_2}$, $\theta_{beam_2}$), . . . , ($\rho_{beam_n}$, $\theta_{beam_n}$) to all of the phased array receiver paths 708-1, 708-2, . . . , 708-*n*, and the polar modulation signals to all of the polar modulation transmitters 702-1, 702-2, . . . , 702-*n***, could alternatively be used.

Second, rather than employing a separate beamformer 606 to generate the beamforming vectors ($\rho_{beam_1}$, $\theta_{beam_1}$), ($\rho_{beam_2}$, $\theta_{beam_2}$), . . . , ($\rho_{beam_n}$, $\theta_{beam_n}$), as is done in the phased array transceiver 600 in FIG. 6, the beamforming functions are integrated with other digital signal processing functions within the combined DSP and beamformer 706. Despite this difference, those skilled in the art will understand that a dedicated beamformer could alternatively be used (similar to as in FIG. 6) to generate beamforming vectors ($\rho_{beam_1}$, $\theta_{beam_1}$), ($\rho_{beam_2}$, $\theta_{beam_2}$), . . . , ($\rho_{beam_n}$, $\theta_{beam_n}$) from beamforming data provided from the DSP and polar signal generators of the polar modulation transmitters 702-1, 702-2 . . . , **702-*n***.

Third, the depictions of the polar modulation transmitters 702-1, 702-2, . . . , **702-*n* in the drawing in FIG. 7 have been somewhat simplified compared to how the polar modulation transmitter 604 is shown in FIG. 6. In particular, the phase and amplitude path DACs are not shown and the envelope and phase modulators are identified using the abbreviations "EM" and "PM", respectively, rather than their full names. Both of these changes have been made for the purpose of simplifying the drawing in FIG. 7**.

The present invention has been described with reference to specific exemplary embodiments. These exemplary embodiments are merely illustrative, and not meant to restrict the scope or applicability of the present invention in any way. Therefore, the inventions should not be construed as being limited to any of the specific exemplary embodiments or applications described above, and various modifications or changes to the specific exemplary embodiments that are naturally suggested to those of ordinary skill in the art should be included within the spirit and purview of the appended claims.

What is claimed is:

1. A phased array receiver, comprising:

a plurality of receive paths;

a plurality of local oscillators, each configured to receive a digital reference phase signal and one of a plurality of independently generated digital phase control signals, each local oscillator having:

an accumulator configured to repeatedly accumulate successive samples of said digital reference phase signal at an accumulation rate to generate a digital reference phase number;

an adder configured to generate a digital sum by adding said digital reference phase number to a digital phase control number carried by one of said plurality of independently generated digital phase control signals;

a converter configured to generate a sine wave having an intermediate frequency based on said accumulation rate and a phase based on said digital sum; and a low pass filter configured to generate a local oscillator signal by removing high-frequency components of said sine wave;

a plurality of downconverters, each coupled to one of said plurality of local oscillators and each configured within one of said plurality of receive paths operable to downconvert a radio frequency signal received in said respective receive path to an intermediate frequency signal according to said respective local oscillator signal of said respective local oscillator; and a combiner configured to combine the intermediate frequency signals.

2. The phased array receiver of claim 1 wherein said converter of each local oscillator has:

a phase-to-amplitude converter configured to generate a digital sine wave having an amplitude based on said digital sum; and a digital-to-analog converter configured to convert said digital sine wave to a sine wave having said intermediate frequency based on said rate of accumulation and said phase based on said amplitude of said digital sine wave.

3. The phased array receiver of claim 2 wherein said accumulation rate is based on a system clock frequency and a size of said accumulator, and wherein said intermediate frequency is based on said accumulation rate and a value carried by said digital reference phase signal.

4. The phased array receiver of claim 1, further comprising a plurality of variable gain elements configured within said plurality of receive paths operable to control the amplitudes of the intermediate frequency signals.

5. The phased array receiver of claim 4 wherein the plurality of variable gain elements are digitally controlled by a plurality of digital gain control signals.

6. The phased array receiver of claim 5 wherein said plurality of digital gain control signals and said plurality of digital phase control signals comprise amplitude and phase components, respectively, of a plurality of digital beamforming vectors.

7. The phased array receiver of claim 5 wherein said plurality of digital gain control signals and said plurality of digital phase control signals comprise amplitude and phase components, respectively, of a plurality of digital calibration vectors.

8. The phased array receiver of claim 5 wherein said plurality of digital gain control signals and said plurality of digital phase control signals comprise amplitude and phase components, respectively, of a plurality of digital vectors formed from a plurality of digital calibration vectors and a plurality of digital beamforming vectors.

9. A method of receiving a plurality of radio frequency signals in a phased array receiver, comprising the steps of:

generating a digital reference phase number by accumulating samples of a digital reference phase signal at an accumulation rate;

generating a plurality of digital sums by adding said digital reference phase number to a plurality of independently generated digital phase control numbers;

generating a plurality of local oscillator signals, each having a substantially identical intermediate frequency based on said accumulation rate and an independently controllable phase based on said respective digital sum;

downconverting said plurality of radio frequency signals received in a plurality of receive paths of said phased array receiver to a plurality of phase shifted intermediate frequency signals based on said plurality of local oscillator signals, each phase shifted intermediate frequency signal having said substantially identical intermediate frequency and said independently controllable phase of said respective local oscillator signal; and combining the phase shifted intermediate frequency signals.

10. The method of claim 9 wherein generating the plurality of local oscillator signals includes digitally controlling the phases of the local oscillator signals to achieve a desired phase relationship among the phases of the intermediate frequency signals.

11. The method of claim 10, further comprising adjusting the amplitudes of the intermediate frequency signals.

12. The method of claim 11 wherein adjusting the amplitudes of the intermediate frequency signals comprises digitally controlling the amplitudes of the intermediate frequency signals.

13. The method of claim 12 wherein digitally controlling the amplitudes of the intermediate frequency signals and digitally controlling the phases of the local oscillator signals is performed according to digital beamforming vectors.

14. The method of claim 12 wherein digitally controlling the amplitudes of the intermediate frequency signals and digitally controlling the phases of the local oscillator signals is performed according to digital calibration vectors.

15. The method of claim 12 wherein digitally controlling the amplitudes of the intermediate frequency signals and digitally controlling the phases of the local oscillator signals is performed according to digital vectors formed from digital calibration and digital beamforming vectors.

16. A phased array receiver, comprising:

means for generating a plurality of phase shift signals by combining a digital reference phase signal with a plurality of digital phase control signals, the means including a plurality of digitally controlled local oscillators, each having an accumulator, an adder, a phase-to-amplitude converter, a digital-to-analog converter, and a low pass filter;

means for simultaneously downconverting and phase shifting a plurality of radio frequency signals to a plurality of intermediate frequency signals by applying said plurality of phase shift signals, each intermediate frequency signal having a substantially identical intermediate frequency and an independently controllable phase; and a combiner for combining said plurality of intermediate frequency signals.

17. The phased array receiver of claim 16, further comprising means for digitally controlling the amplitudes of the intermediate frequency signals.

18. The phased array receiver of claim 17 wherein said means for digitally controlling the amplitudes of the intermediate frequency signals and said means for digitally controlling the phases of the intermediate frequency signals are configured to control the amplitudes and phases of the intermediate frequency signals in response to digital beamforming vectors.

19. The phased array receiver of claim 17 wherein said means for digitally controlling the amplitudes of the intermediate frequency signals and said means for digitally controlling the phases of the intermediate frequency signals are configured to control the amplitudes and phases of the intermediate frequency signals in response to digital calibration vectors.

20. The phased array receiver of claim 17 wherein said means for digitally controlling the amplitudes of the intermediate frequency signals and said means for digitally controlling the phases of the intermediate frequency signals are configured to control the amplitudes and phases of the intermediate frequency signals in response to a combination of digital beamforming vectors and digital calibration vectors.

21. A phased array transceiver, comprising:

one or more polar modulation transmitters having means for generating polar signals, said means for generating polar signals configured to generate polar modulation signals for the one or more polar modulation transmitters, a plurality of independent digital gain control signals, and a plurality of independent digital phase control signals; and a phased array receiver having:

a plurality of receive paths;

a plurality of local oscillators, each configured to receive a digital reference phase signal and one of said plurality of independent digital phase control signals, each local oscillator having:

an accumulator configured to repeatedly accumulate successive samples of said digital reference phase signal at an accumulation rate to generate a digital reference phase number;

an adder configured to generate a digital sum by adding said digital reference phase number to a digital phase control number carried by one of said plurality of independent digital phase control signals;

a converter configured to generate a sine wave having an intermediate frequency based on said accumulation rate and a phase based on said digital sum; and a low pass filter configured to generate a local oscillator signal by removing high-frequency components of said sine wave;

a plurality of downconverters, each coupled to one of said plurality of local oscillators, and each configured within one of said plurality of receive paths operable to downconvert a radio frequency signal received in said respective receive path to an intermediate frequency signal based on said respective local oscillator signal of said respective local oscillator; and a combiner configured to combine said intermediate frequency signals.

* * * * *